US010150314B2

(12) United States Patent
Kumai et al.

(10) Patent No.: US 10,150,314 B2
(45) **Date of Patent: *Dec. 11, 2018**

(54) LIQUID EJECTING APPARATUS AND TENSION APPLYING METHOD

(71) Applicant: SEIKO EPSON CORPORATION, Tokyo (JP)

(72) Inventors: Eiji Kumai, Mastumoto (JP); Takashi Akahane, Miyata-mura (JP); Yoji Takahashi, Matsumoto (JP); Osamu Murayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/454,149

(22) Filed: Mar. 9, 2017

(65) Prior Publication Data

US 2017/0173983 A1 Jun. 22, 2017

Related U.S. Application Data

(63) Continuation of application No. 14/867,228, filed on Sep. 28, 2015, now Pat. No. 9,617,106.

(30) Foreign Application Priority Data

Oct. 1, 2014 (JP) ..... 2014-202862
Oct. 1, 2014 (JP) ..... 2014-202865

(51) Int. Cl.
*B41J 15/16* (2006.01)
*B65H 23/16* (2006.01)
*B65H 23/195* (2006.01)

(52) U.S. Cl.
CPC ..... *B41J 15/165* (2013.01); *B65H 23/16* (2013.01); *B65H 23/195* (2013.01); *B65H 2801/15* (2013.01)

(58) Field of Classification Search
CPC ..... B65H 23/16; B65H 23/1955; B65H 2801/15; B41J 15/16; B41J 15/165; B41J 2/16585
(Continued)

(56) References Cited

U.S. PATENT DOCUMENTS 6,319,539 B1 11/2001 Shemer et al.
6,379,738 B1 4/2002 Dingman et al.
(Continued)

FOREIGN PATENT DOCUMENTS

EP 0310375 4/1989
EP 1493337 1/2005
(Continued)

OTHER PUBLICATIONS

International Search Report and Written Opinion issued in PCT Application No. PCT/IB2015/057644, dated Dec. 14, 2015.
(Continued)

*Primary Examiner* — Jannelle M Lebron
(74) *Attorney, Agent, or Firm* — Workman Nydegger

(57) ABSTRACT

A liquid ejecting apparatus includes an ejecting unit that is capable of ejecting a liquid; and a tension adjusting unit that is rotatable about a rotational shaft and that is capable of applying a tension to a medium by coming into contact with the medium onto which the liquid is ejected. The tension adjusting unit is capable of applying the tension to the medium at a balancing position at which the tension adjusting unit is balanced by a weight of the tension adjusting unit.

8 Claims, 8 Drawing Sheets

(58) Field of Classification Search
USPC ..... 347/16, 104
See application file for complete search history.

(56) References Cited

U.S. PATENT DOCUMENTS

| | | | | |
|---|---|---|---|---|
| 6,613,369 | B2 | 9/2003 | Gaebler et al. | |
| 6,649,206 | B2 | 11/2003 | Dingman et al. | |
| 7,556,836 | B2 | 7/2009 | Meuller et al. | |
| 7,736,686 | B2 | 6/2010 | Dingman et al. | |
| 7,838,057 | B2 | 11/2010 | Schmidt et al. | |
| 9,617,106 | B2 * | 4/2017 | Kumai | B41J 15/165 |
| 2007/0148323 | A1 | 6/2007 | Dingman et al. | |
| 2010/0194814 | A1 | 8/2010 | Izawa et al. | |
| 2011/0242245 | A1 * | 10/2011 | Okazaki | B41J 11/0085 347/104 |
| 2012/0008994 | A1 | 1/2012 | Tomita | |
| 2012/0093994 | A1 | 4/2012 | Hsieh et al. | |
| 2012/0189751 | A1 | 7/2012 | Beinecke et al. | |
| 2013/0015944 | A1 | 1/2013 | Takeda | |
| 2013/0284846 | A1 | 10/2013 | Turner et al. | |

FOREIGN PATENT DOCUMENTS

| | | |
|---|---|---|
| EP | 1758462 | 3/2007 |
| EP | 2063719 | 6/2009 |
| JP | 2004-107021 | 4/2004 |
| JP | 2004-314565 | 11/2004 |
| WO | 2009114077 | 9/2009 |
| WO | 2011011456 | 1/2011 |
| WO | 2012009548 | 1/2012 |
| WO | 2012103056 | 8/2012 |

OTHER PUBLICATIONS

Notice of Allowance issued in U.S. Appl. No. 14/867,228 dated Dec. 7, 2016.
Office Action issued in U.S. Appl. No. 14/867,228 dated Sep. 9, 2016.
Office Action issued in U.S. Appl. No. 14/867,228 dated Apr. 12, 2016.

* cited by examiner

LIQUID EJECTING APPARATUS AND TENSION APPLYING METHOD

BACKGROUND

1. Technical Field

The present invention relates to a liquid ejecting apparatus and a tension applying method.

2. Related Art

A recording apparatus is known that transports a rolled medium on which an image is printed by using a recording head. The recording apparatus includes a tension roller which applies a tension to the medium (see, for example, JP-A-2004-314565).

The tension roller of the recording apparatus adjusts the tension by using a weight attached to the tension roller. The posture of the tension roller may be unstable, for example, when the tension roller is retracted to replace the rolled medium.

SUMMARY

The present invention can be realized as following application examples and embodiments.

Application Example 1

A liquid ejecting apparatus according to Application Example 1 includes an ejecting unit that is capable of ejecting a liquid; and a tension adjusting unit that is rotatable about a rotational shaft and that is capable of applying a tension to a medium by coming into contact with the medium onto which the liquid is ejected, in which the tension adjusting unit is capable of applying the tension to the medium at a balancing position at which the tension adjusting unit is balanced by a weight of the tension adjusting unit.

In this configuration, the tension adjusting unit applies the tension to the medium at the balancing position. This can stabilize the posture of the tension adjusting unit.

Application Example 2

In the liquid ejecting apparatus, the rotational shaft may substantially coincide with a center of gravity of the tension adjusting unit.

In this configuration, when the tension adjusting unit is deviated from the balancing position, the tension adjusting unit is urged so as to return to the balancing position. Accordingly, the posture of the tension adjusting unit can be made more stable.

Application Example 3

In the liquid ejecting apparatus, the tension adjusting unit may include a weight member.

In this configuration, a position of the center of gravity of the tension adjusting unit can be adjusted. This can readily set the balancing position at a suitable position.

Application Example 4

The liquid ejecting apparatus may further include a fixing unit that is capable of fixing the tension adjusting unit. The fixing unit fixes the tension adjusting unit when the tension adjusting unit is at a retracted position at which the tension adjusting unit does not apply any tension to the medium.

In this configuration, the tension adjusting unit can be fixed at the retracted position when not applying any tension to the medium.

Application Example 5

In the liquid ejecting apparatus, the fixing unit may include a magnet which fixes the tension adjusting unit.

In this configuration, a magnetic force of the magnet can securely fix the tension adjusting unit.

Application Example 6

In the liquid ejecting apparatus, the fixing unit may include an arm which fixes the tension adjusting unit.

In this configuration, the arm can securely fix the tension adjusting unit.

Application Example 7

A tension applying method according to Application Example 7 is for applying a tension to a medium onto which a liquid is ejected by a liquid ejecting apparatus which includes a tension adjusting unit, the tension adjusting unit being rotatable about a rotational shaft and being capable of applying the tension to the medium by coming into contact with the medium. The tension applying method includes applying the tension to the medium by using the tension adjusting unit when the tension adjusting unit is disposed at a balancing position at which the tension adjusting unit is balanced by a weight of the tension adjusting unit.

In this configuration, the tension adjusting unit applies the tension to the medium at the balancing position. This can stabilize the posture of the tension adjusting unit.

Application Example 8

A liquid ejecting apparatus according to Application Example 8 includes an ejecting unit that is capable of ejecting a liquid; and a tension adjusting unit that is capable of applying a tension to a medium by coming into contact with the medium onto which the liquid is ejected and that is movable between a first position and a second position, the first position being a position at which the tension adjusting unit applies the tension to the medium, and the second position being a position at which the tension adjusting unit does not apply any tension to the medium, in which the tension adjusting unit includes a first weight member and a second weight member, when the tension adjusting unit is positioned closer to the first position than a balancing position which is between the first position and the second position, the tension adjusting unit is urged toward the first position by a weight of the first weight member, and when the tension adjusting unit is positioned closer to the second position than the balancing position, the tension adjusting unit is urged toward the second position by a weight of the second weight member.

In this configuration, the posture of the tension adjusting unit can be stabilized at each of the first position at which the tension adjusting unit applies the tension to the medium and the second position at which the tension adjusting unit does not apply any tension to a medium.

Application Example 9

In the liquid ejecting apparatus, the first weight member may be a tension bar which applies the tension to the medium by coming into contact with the medium.

In this configuration, the tension bar functions as the first weight member. Therefore, it is not necessary to additionally dispose a first weight member, and as a result, the tension adjusting unit can be simplified.

Application Example 10

In the liquid ejecting apparatus, the tension adjusting unit may rotate about a shaft so as to move between the first position and the second position, in which the shaft is positioned between the first weight member and the second weight member.

In this configuration, the tension adjusting unit rotates about the shaft which is positioned between the first weight member and the second weight member. This can stabilize the posture of the tension adjusting unit.

Application Example 11

In the liquid ejecting apparatus, a distance between the first weight member and the shaft may be different from a distance between the second weight member and the shaft.

In this configuration, a position of the balancing position can be adjusted by making there be a difference between the distance between the first weight member and the shaft, and the distance between the second weight member and the shaft.

Application Example 12

In the liquid ejecting apparatus, a weight of the first weight member may be different from a weight of the second weight member.

In this configuration, the position of the balancing position can be adjusted by making there be a difference between the weight of the first weight member and the weight of the second weight member.

Application Example 13

In the liquid ejecting apparatus, one of the weight of the first weight member and the weight of the second weight member may be greater than the other. A distance between the one and the shaft is shorter than a distance between the other one and the shaft.

In this configuration, the posture of the tension adjusting unit can be stabilized by adjusting the weights of the first and second weight members, and the distances between the first and second weight members and the shaft.

Application Example 14

In the liquid ejecting apparatus, when the tension adjusting unit is positioned closer to the first position than the balancing position, the tension adjusting unit may be moved to the first position by the weight of the first weight member.

In this configuration, the tension adjusting unit is prevented from stopping at an unstable position, and the posture of the tension adjusting unit can be stabilized by the weight of the first weight member at the first position.

Application Example 15

In the liquid ejecting apparatus, when the tension adjusting unit is positioned closer to the second position than the balancing position, the tension adjusting unit may be moved to the second position by the weight of the second weight member.

In this configuration, the tension adjusting unit is prevented from stopping at an unstable position, and the posture of the tension adjusting unit can be stabilized by the weight of the second weight member at the second position.

Application Example 16

A moving method for moving a tension adjusting unit according to Application Example 16 is for moving the tension adjusting unit which is included in a liquid ejecting apparatus, the tension adjusting unit including a first weight member and a second weight member, and being movable between a first position and a second position, the first position being a position at which the tension adjusting unit applies a tension to a medium onto which a liquid is ejected, and the second position being a position at which the tension adjusting unit does not apply any tension to the medium, in which in a case where the tension adjusting unit applies the tension to the medium, the tension adjusting unit is moved to a position at which an urging force is applied in a direction from the second position to the first position by a weight of the first weight member, and in a case where the tension adjusting unit does not apply any tension to the medium, the tension adjusting unit is moved to a position at which an urging force is applied in a direction from the first position to the second position by a weight of the second weight member.

In this configuration, the posture of the tension adjusting unit can be stabilized at the first and second positions, the first position being a position at which the tension adjusting unit applies the tension to the medium, and the second position being a position at which the tension adjusting unit does not apply any tension to the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
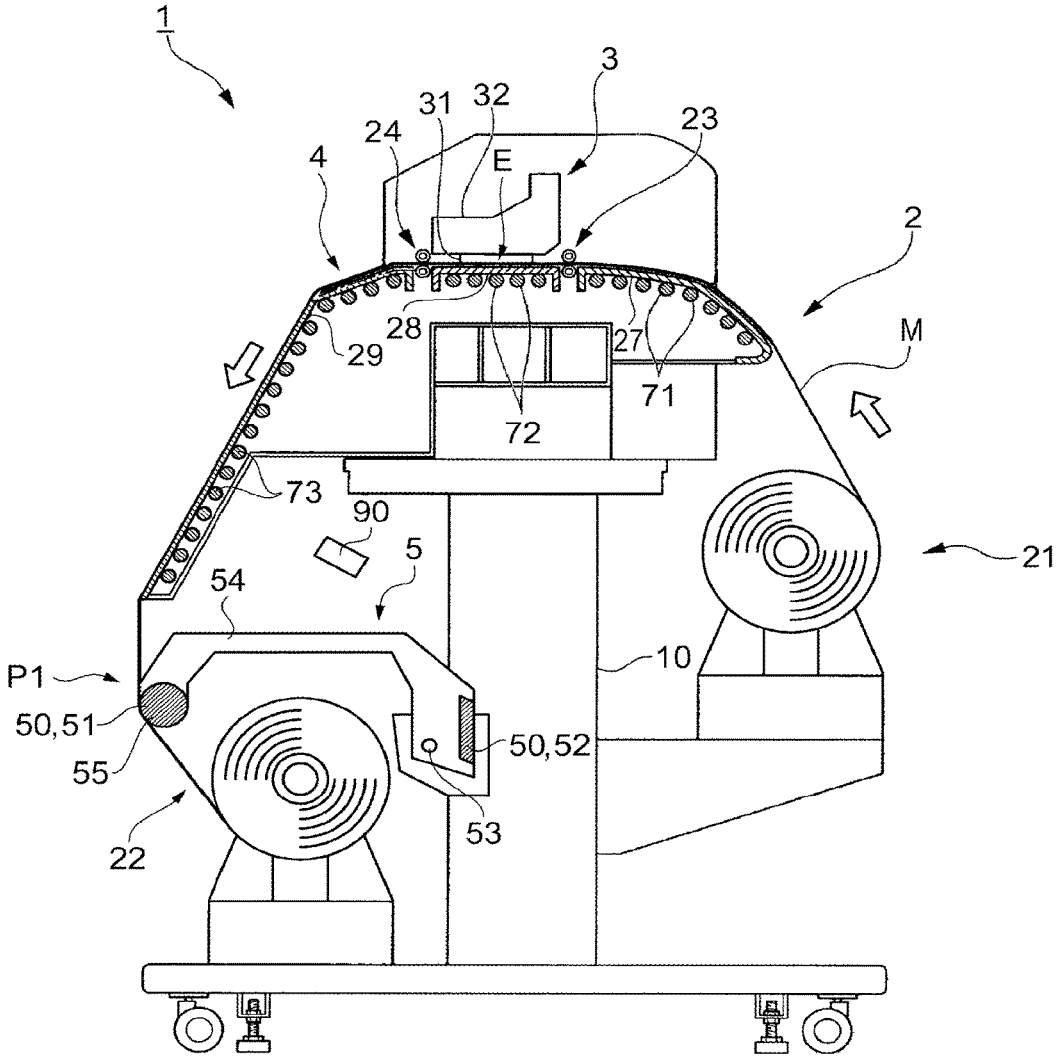
FIG. 1 schematically illustrates a configuration of a liquid ejecting apparatus according to a first embodiment of the invention.

Exemplary embodiments of the invention will be described below with reference to drawings. Note that the scales of members and the like are different from the real scales thereof so as to be recognizable in the drawings.

In the exemplary embodiments, a liquid ejecting apparatus is an ink jet printer, for example. In the following exemplary embodiments, a large format printer (LFP) for relatively large mediums will be described as an example of a liquid ejecting apparatus.

First Embodiment

Figure 2:
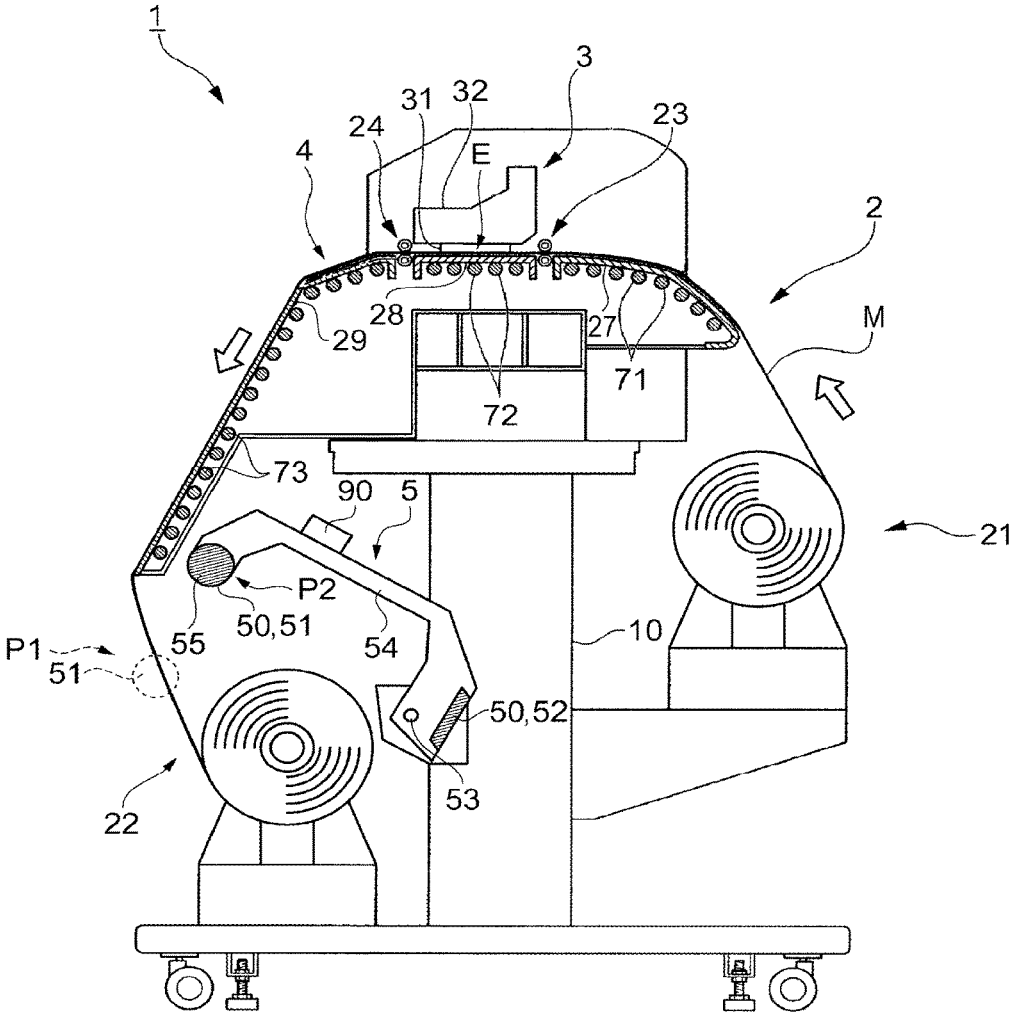
FIG. 2 schematically illustrates the configuration of the liquid ejecting apparatus.

First, a configuration of a liquid ejecting apparatus 1 according to a first embodiment will be described. FIGS. 1 and 2 schematically illustrate the configuration of the liquid ejecting apparatus. As illustrated in FIGS. 1 and 2, the liquid ejecting apparatus 1 includes a transportation unit 2, an ejecting unit 3, a medium supporting member 4, and a tension adjusting unit 5. The transportation unit 2 transports a medium M by a roll-to-roll method. The ejecting unit 3 ejects (discharges) ink, as an example of liquid, onto a predetermined area of the medium M so as to record images, characters, and the like. The medium supporting member 4 supports the medium M. These components are supported by a body frame 10. Note that the medium M is, for example, a vinyl chloride-based film whose width is about 64 inches.

The transportation unit 2 includes rollers 21 and 22. The roller 21 feeds the rolled medium M in a transporting direction (the direction of the arrows in FIGS. 1 and 2). The roller 22 rolls the fed medium M up. The transportation unit 2 includes pairs of transporting rollers 23 and 24 which transport the medium M though a transportation path between the rollers 21 and 22.

The ejecting unit 3 includes a recording head (ink jet head) 31 and a carriage 32. The recording head 31 is capable of ejecting ink, as an example of a liquid, onto the medium M. The carriage 32 is capable of reciprocating in a width direction of the medium M with the recording head 31 being mounted on the carriage 32. The recording head 31 includes plural nozzles and is capable of ejecting ink. The ink is selected according to the medium M and needs to be subjected to penetration drying or evaporation drying. Images, characters, and the like can be recorded onto the medium M by ejecting ink from the recording head 31 while reciprocating the carriage 32. That is, the liquid ejecting apparatus 1 includes the ejecting unit 3 capable of ejecting liquid.

The medium supporting member 4 supports the medium M at the transportation path of medium M and includes an upstream supporting member 27, a platen 28, and a downstream supporting member 29. The upstream supporting member 27 is disposed between the roller 21 and the pair of transporting rollers 23. The platen 28 is disposed between the pairs of transporting rollers 23, 24. The downstream supporting member 29 is disposed between the pair of transporting rollers 24 and the roller 22.

In addition, the liquid ejecting apparatus 1 includes heating units capable of heating the medium M. In this embodiment, the liquid ejecting apparatus 1 includes a first heater (pre-heater) 71, a second heater (platen heater) 72, and a third heater (after-heater) 73. The first heater 71 preheats the medium M on the upstream side of the ejecting unit 3 in the transporting direction. The first heater 71 is disposed between the roller 21 and the pair of transporting rollers 23 and is disposed at a rear surface opposite to a surface supporting the medium M at the upstream supporting member 27. The second heater 72 heats the medium M at an ejection area E of the ejecting unit 3. The second heater 72 is disposed at a rear surface opposite to a surface supporting the medium M at the platen 28. The third heater 73 heats the medium M so as to dry and fix ink onto the medium M quickly. This prevents the ink from bleeding and blurring and enhances image quality. The third heater 73 is disposed at a rear surface opposite to a surface supporting the medium M at the downstream supporting member 29. The first, second, and third heaters 71, 72, 73 are, for example, tube heaters and are adhered respectively to rear surfaces of the upstream supporting member 27, the platen 28, and the downstream supporting member 29 by using aluminum tapes or the like. The first, second, and third heaters 71, 72, 73 are driven, so that surfaces supporting the medium M at the medium supporting member 4 are heated through heat conductivity. Thus, the medium M can be heated from a rear surface thereof.

For example, a heating temperature of the first heater 71 is set at 40° C., and a heating temperature of the second heater 72 is set at 40° C. (target temperature). In addition, a heating temperature of the third heater 73 is set at 50° C. which is higher than those of the first heater 71 and the second heater 72.

The first heater 71 heats the medium M so that a temperature of the medium M is gradually increased from a normal temperature toward the target temperature (temperature of the second heater 72). Thus, the first heater 71 increases the drying speed after ink has been deposited. The second heater 72 keeps the medium M at the target temperature when ink is ejected onto the medium M. Thus, the second heater 72 increases the drying speed after ink has been deposited. The third heater 73 heats the medium M at a temperature higher than the target temperature so as to dry undried ink among ink ejected onto the medium M. The third heater 73 dries and fixes ink ejected onto the medium M completely at least before the roller 22 rolls the medium M up.

Figure 3A:
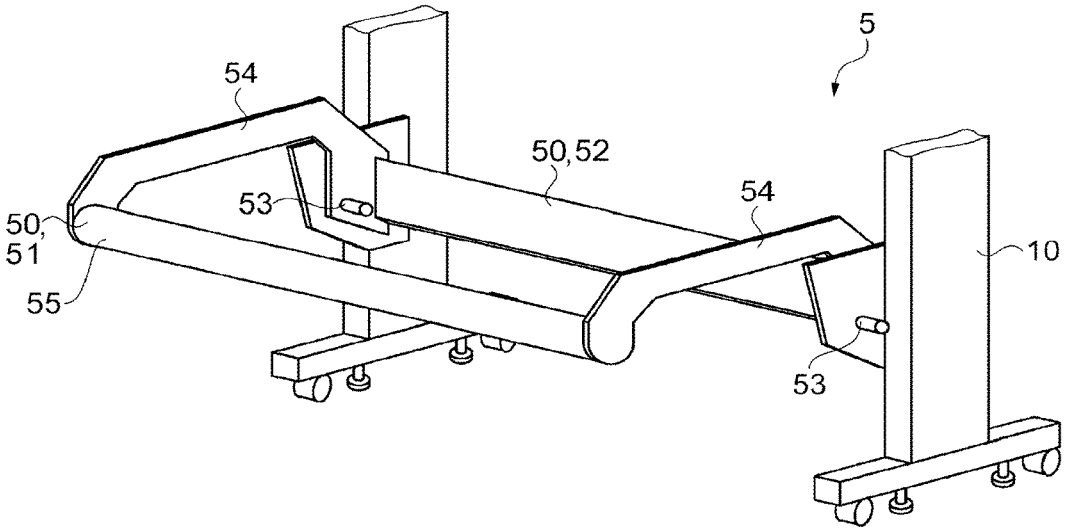
FIGS. 3A and 3B are perspective views illustrating a configuration of a tension adjusting unit.
Figure 3B:
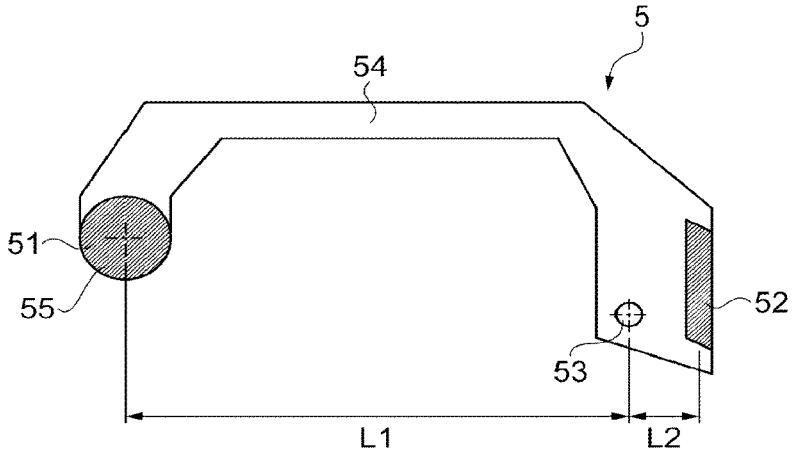

The tension adjusting unit 5 is capable of applying a tension to the medium M. In this embodiment, the tension adjusting unit 5 is disposed so as to be capable of applying the tension to the medium M at a position between the downstream supporting member 29 and the roller 22. The tension adjusting unit 5 will be described below in detail with reference to FIGS. 1 to 3B. Note that FIG. 1 illustrates the tension adjusting unit 5 positioned at a first position P1. FIG. 2 illustrates the tension adjusting unit 5 positioned at a second position P2. FIG. 3A is an external perspective view illustrating a structure of the tension adjusting unit 5. FIG. 3B is a side cross-sectional view illustrating the structure of the tension adjusting unit 5.

The tension adjusting unit 5 is rotatable about a rotational shaft 53. The tension adjusting unit 5 is capable of applying a tension to the medium M by coming into contact with the medium M onto which liquid is ejected by the ejecting unit 3. The tension adjusting unit 5 can move to the first position P1 as an example of a balancing position at which the tension adjusting unit 5 is balanced by a weight of the tension adjusting unit 5. The tension adjusting unit 5 is capable of applying the tension to the medium M at the first position P1. That is, the tension adjusting unit 5 is capable of applying the tension to the medium M at the balancing position at which the tension adjusting unit 5 is balanced by the weight of the tension adjusting unit 5. The tension adjusting unit 5 applies the tension to the medium M at the balancing position and, therefore, a posture of the tension adjusting unit 5 can be stabilized. By stabilizing the posture of the tension adjusting unit 5, variation in the tension, which is applied to the medium M by the tension adjusting unit 5, can be suppressed. However, the tension adjusting unit 5 may apply the tension to the medium M at a position other than the balancing position. While applying the tension to the medium M, the tension adjusting unit 5 may rotate by coming into contact with the medium M. In this manner, the tension adjusting unit 5 can apply the tension to the medium M at a position shifted with respect to the balancing position. In this embodiment, centers of gravity of the rotational shaft 53 and the tension adjusting unit 5 are set to substantially coincide with each other. Accordingly, even if the tension adjusting unit 5 is shifted with respect to the balancing position, the tension adjusting unit 5 is urged so as to return to the balancing position. That is, when the tension adjusting unit 5 is shifted with respect to the balancing position, a force, which returns the tension adjusting unit 5 to the balancing position, is applied to the tension adjusting unit 5. Accordingly, the posture of the tension adjusting unit 5 can be made more stable. Note that it is possible that centers of gravity of the rotational shaft 53 and the tension adjusting unit 5 do not coincide with each other completely. Even if the tension adjusting unit 5 is shifted with respect to the balancing position by about plus or minus 30 degrees, centers of gravity of the rotational shaft 53 and the tension adjusting unit 5 can be considered to coincide with each other as long as the tension adjusting unit 5 is urged so as to return to the balancing position.

As illustrated in FIG. 3A, the tension adjusting unit 5 includes weight members 50. Specifically, the tension adjusting unit 5 includes a pair of frames 54, and the weight members 50, which include a first weight member 51 and a second weight member 52, are disposed between the pair of frames 54. Note that the weight member 50 may be single and may include three or more weight members 50. By adjusting the weight and/or the position of the weight member 50, the position of the center of gravity of the tension adjusting unit 5 can be adjusted. Thus, the balancing position can be set to a suitable position readily. In addition, the tension adjusting unit 5 includes a columnar tension bar 55, and the tension bar 55 is disposed between one-side ends of the frames 54. The tension bar 55 is formed to be longer than the width of the medium M in a width direction. Then, a part of the tension bar 55 comes into contact with the medium M and applies the tension to the medium M. Note that the tension bar 55 has a function of the first weight member 51 in this embodiment. This can simplify the structure of the tension adjusting unit 5. The plate-shaped second weight member 52 is disposed between the other-side ends of the frames 54. The weights of the first and second weight members 51 and 52 can be set suitably. Accordingly, a balancing position of the tension adjusting unit 5 can be set desirably.

The tension adjusting unit 5 can be moved by rotating the tension adjusting unit 5 about the rotational shaft 53 disposed on the body frame 10. As illustrated in FIG. 3B, the rotational shaft 53 is located between the first weight member 51 (the tension bar 55) and the second weight member 52 in a side view of the tension adjusting unit 5. A distance L1 between the first weight member 51 and the rotational shaft 53 is different from the distance L2 between the second weight member 52 and the rotational shaft 53. The weight of the first weight member 51 is different from the weight of the second weight member 52. Specifically, the weight of one of the first weight member 51 and the second weight member 52 is greater than the weight of the other one. A distance between the rotational shaft 53 and the one of the first weight member 51 and the second weight member 52 is shorter than a distance between the rotational shaft 53 and the other one. In this embodiment, the weight of the second weight member 52 is greater than the weight of the first weight member 51. The distance L2 between the second weight member 52, the weight of which is greater than the weight of the first weight member 51, and the rotational shaft 53 is shorter than the distance L1 between the first weight member 51, the weight of which is lower than the weight of the second weight member 52, and the rotational shaft 53. Accordingly, the tension adjusting unit 5 can move to the balancing position at which the tension adjusting unit 5 is balanced by the weight of the tension adjusting unit 5. Note that the balancing position represents a position at which an urging force of the first weight member 51 is balanced with an urging force of the second weight member 52. Note that, in this embodiment, the urging force of the first weight member 51 represents an urging force counterclockwise in FIG. 1, and the urging force of the second weight member 52 represents an urging force clockwise in FIG. 1.

Then, as illustrated in FIG. 1, the tension adjusting unit 5 moves to the first position P1, where the weight of the tension adjusting unit 5 maintains a balance, and applies the tension to the medium M at the first position P1. At this time, the tension adjusting unit 5 applies the tension to the medium M while being balanced. Accordingly, the posture of the tension adjusting unit 5 becomes stable, and variation in the tension, which is applied to the medium M, is suppressed.

In addition, as illustrated in FIG. 2, the tension adjusting unit 5 can be moved to the second position P2 by rotating about the rotational shaft 53. The second position P2 is an example of a retracted position at which the tension adjusting unit 5 does not apply any tension to the medium M. Note that, in this embodiment, a position, where the rotational shaft 53 is disposed, is substantially a center of gravity position. Therefore, when the tension adjusting unit 5 is moved to the second position P2, the posture of the tension adjusting unit 5 may become unstable. This is because the tension adjusting unit 5 is urged so as to return to the balancing position while being shifted with respect to the balancing position. Therefore, the liquid ejecting apparatus 1 includes a fixing unit 90 which can fix the tension adjusting unit 5. When the tension adjusting unit 5 is at the second position (retracted position) P2 at which the tension adjusting unit 5 does not apply any tension to the medium M, the fixing unit 90 fixes the tension adjusting unit 5. Accordingly, the tension adjusting unit 5 can be fixed at the retracted position when not applying any tension to the medium M. In this embodiment, the fixing unit 90 is disposed on the body frame 10. The fixing unit 90 includes a magnet (for example, permanent magnet), and the magnet fixes the tension adjusting unit 5. Therefore, the tension adjusting unit 5 is fixed securely by magnetic force. In this case, a part of the tension adjusting unit 5 is made of iron. Specifically, parts of the frames 54 of the tension adjusting unit 5 are made of iron. When the tension adjusting unit 5 is moved to the second position P2 and parts of the frames 54 of the tension adjusting unit 5 contact with the fixing unit 90, the tension adjusting unit 5 is fixed by magnetic force. Note that the frame 54 may be made of a magnetic material such as iron, nickel, or the like. In addition, the frame 54 may be made of magnetic alloy, a mixture of magnetic materials, or the like. On the contrary, a part of the body frame 10 may be made of iron, and the tension adjusting unit 5 may include a magnet.

Next, a tension applying method will be described. Note that, in this embodiment, the tension applying method for applying a tension to the medium M in the liquid ejecting apparatus 1 will be described, the liquid ejecting apparatus 1 including the tension adjusting unit 5 which is rotatable about the rotational shaft 53 and is capable of applying the tension to the medium M by coming into contact with the medium M onto which liquid is ejected.

The tension applying method according to this embodiment applies the tension to the medium M by using the tension adjusting unit 5 which is positioned at the balancing position at which the tension adjusting unit 5 is balanced by the weight of the tension adjusting unit 5.

Specifically, at first, in the case of applying the tension to the medium M, that is, in the case of recording (printing) images, characters, and the like onto the medium M by driving the ejecting unit 3, and transporting the medium M, as illustrated in FIG. 1, the tension adjusting unit 5 is moved to the first position P1. The first position P1 is a position at which the weight of the tension adjusting unit 5 maintains a balance. Then, the tension bar 55 of the tension adjusting unit 5 contacts the medium M and thus applies the tension to the medium M.

On the contrary, when the tension adjusting unit 5 does not apply any tension to the medium M, that is, in a non-printing time, for example, when the roller 22 rolling up the medium M is removed, as illustrated in FIG. 2, the tension adjusting unit 5 is moved to the second position P2 as the retracted position. Thus, the posture of the tension adjusting unit 5 may become unstable. Therefore, the tension adjusting unit 5 is fixed at the second position P2 by the fixing unit 90. In this case, for example, the fixing unit 90 is made of a magnet, the frames 54 of the tension adjusting unit 5 are made of iron, and the tension adjusting unit 5 is fixed by magnetic force.

The above-described embodiment ensures the following effects.

The tension adjusting unit 5 applies the tension to the medium M at the first position P1 at which the weight of the tension adjusting unit 5 maintains a balance. Therefore, the posture of the tension adjusting unit 5 can be stabilized, and the variation in the tension, which is applied to the medium M, can be suppressed. In addition, when the tension adjusting unit 5 does not apply any tension to the medium M, the tension adjusting unit 5 can be moved to the second position (retracted position) P2 and can be fixed securely by the fixing unit 90. Accordingly, the posture of the tension adjusting unit 5 can be stabilized. This can improve operability.

Second Embodiment

A configuration of a liquid ejecting apparatus 1*a* according to a second embodiment of the invention will be described.

Figure 4:
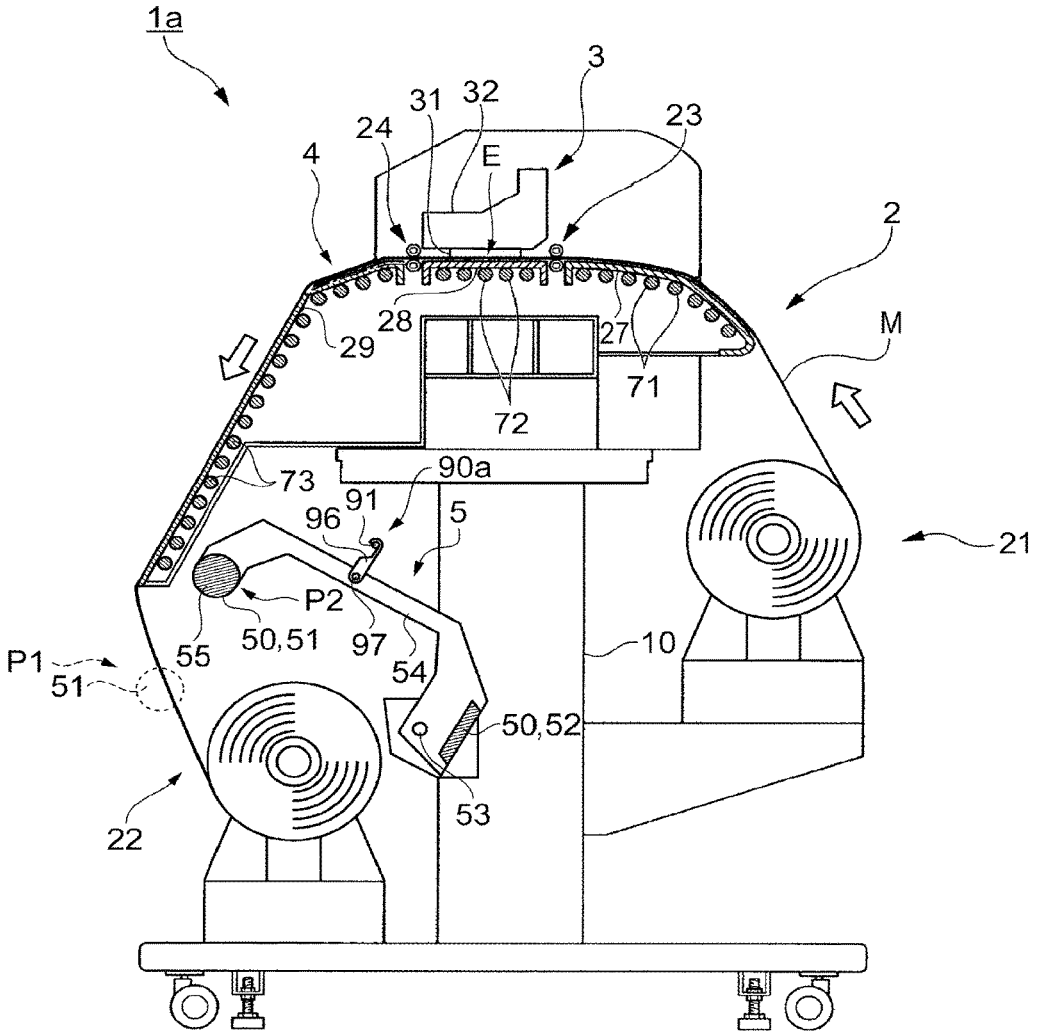
FIG. 4 schematically illustrates a configuration of a liquid ejecting apparatus according to a second embodiment of the invention.

In the above-described first embodiment, the magnet serves as the fixing unit 90 of the liquid ejecting apparatus 1. However, the invention is not limited to this configuration. In the second embodiment, an arm serves as a fixing unit 90*a*. FIG. 4 schematically illustrates a configuration of a liquid ejecting apparatus according to the second embodiment in a state in which the tension adjusting unit is positioned at the second position. Note that, the same reference numerals are given to the same portions as those in the description of the first embodiment, and description thereof will be omitted.

As illustrated in FIG. 4, the liquid ejecting apparatus 1*a* includes the fixing unit 90*a*. The fixing unit 90*a* includes the arm 96, a fixed shaft 91, and a shaft 97. The fixing unit 90*a* fixes the tension adjusting unit 5 to the body frame 10 by the arm 96. Thus, the tension adjusting unit 5 can be fixed securely by the arm 96.

Specifically, the arm 96 and the shaft 97 are disposed at a side surface of the frame 54 of the tension adjusting unit 5. The arm 96 is bent at a tip end portion thereof in a hook shape. The arm 96 is rotatable about the shaft 97.

The fixed shaft 91 is disposed at the body frame 10. When the tension adjusting unit 5 is moved to the second position P2, the tip end portion of the arm 96 is hooked to the fixed shaft 91 with the arm 96 being rotated about the shaft 97. Accordingly, the tension adjusting unit 5 can be fixed at the second position P2.

Note that in the case of applying the tension to the medium M, the arm 96 is rotated about the shaft 97, the tip end portion of the arm 96 is released from the fixed shaft 91, and the tension adjusting unit 5 is moved to the first position P1. Thus, the tension bar 55 of the tension adjusting unit 5 can contact the medium M and can apply the tension to the medium M. Note that the arm 96 and the shaft 97 may be disposed at the body frame 10, and the fixed shaft 91 may be disposed at the frame 54.

Third Embodiment

Figure 5:
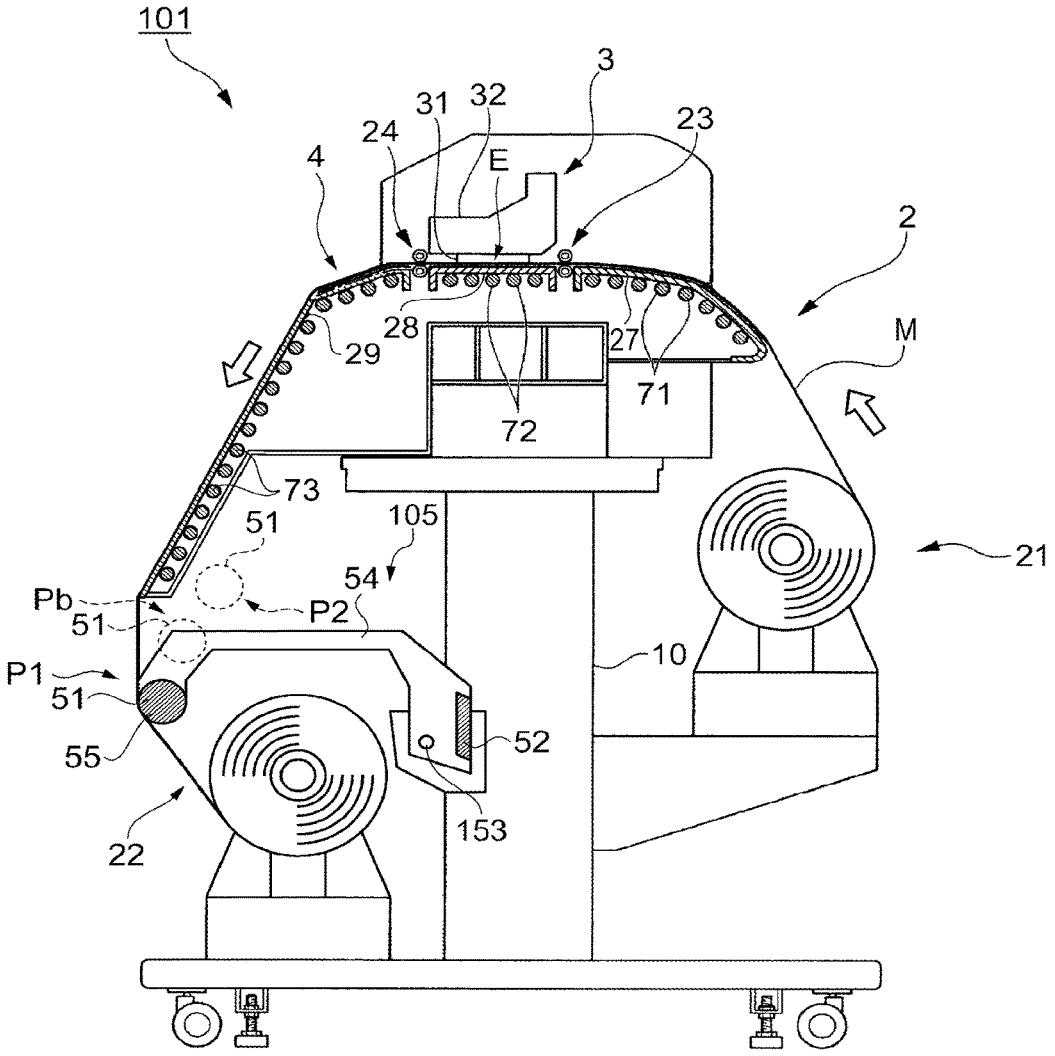
FIG. 5 schematically illustrates a configuration of a liquid ejecting apparatus according to a third embodiment of the invention.

First, the configuration of a liquid ejecting apparatus 101 according to the third embodiment will be described. FIG. 5 schematically illustrates the configuration of the liquid ejecting apparatus according to the third embodiment.

As illustrated in FIG. 5, the liquid ejecting apparatus 101 includes the transportation unit 2, the ejecting unit 3, the medium supporting member 4, and a tension adjusting unit 105. The transportation unit 2 transports a medium M by a roll-to-roll method. The ejecting unit 3 ejects (discharges) ink, as an example of liquid, onto the predetermined area of the medium M so as to record images, characters, and the like. The medium supporting member 4 supports the medium M. These components are supported by the body frame 10. Note that the medium M is, for example, a vinyl chloride-based film whose width is about 64 inches.

The transportation unit 2, the ejecting unit 3, and the medium supporting member 4 are the same as those in the first embodiment 1, and therefore description thereof will be omitted.

The liquid ejecting apparatus 101 includes a heating unit capable of heating the medium M. In this embodiment, the liquid ejecting apparatus 101 includes the first heater (pre-heater) 71, the second heater (platen heater) 72, and the third heater (after-heater) 73. The first heater 71, the second heater 72, and the third heater 73 are the same as those in the first embodiment 1, and therefore description thereof will be omitted.

The tension adjusting unit 105 is capable of applying the tension to the medium M. In this embodiment, the tension adjusting unit 105 is disposed so as to be capable of applying the tension to the medium M at a position between the downstream supporting member 29 and the roller 22. Specifically, the tension adjusting unit 105 is capable of applying the tension to the medium M by coming into contact with the medium M onto which liquid is ejected. In addition, the tension adjusting unit 105 can move between the first position P1 and the second position P2. The first position P1 is a position at which the tension adjusting unit 105 applies the tension to the medium M. The second position P2 is a position at which the tension adjusting unit 105 does not apply any tension to the medium M. A balancing position Pb exists between the first position P1 and the second position P2. The tension adjusting unit 105 will be described below in detail.

Figure 6:
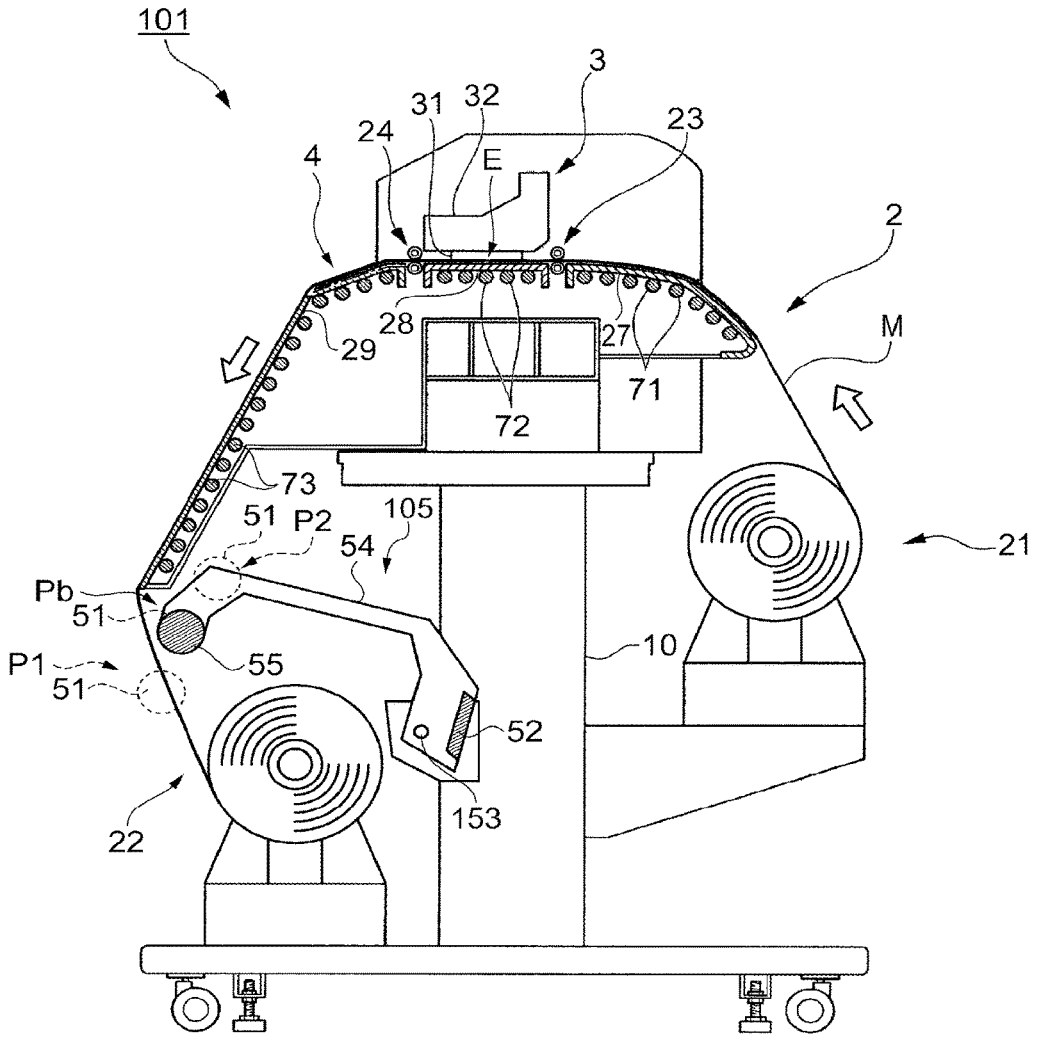
FIG. 6 schematically illustrates the configuration of the liquid ejecting apparatus.
Figure 7:
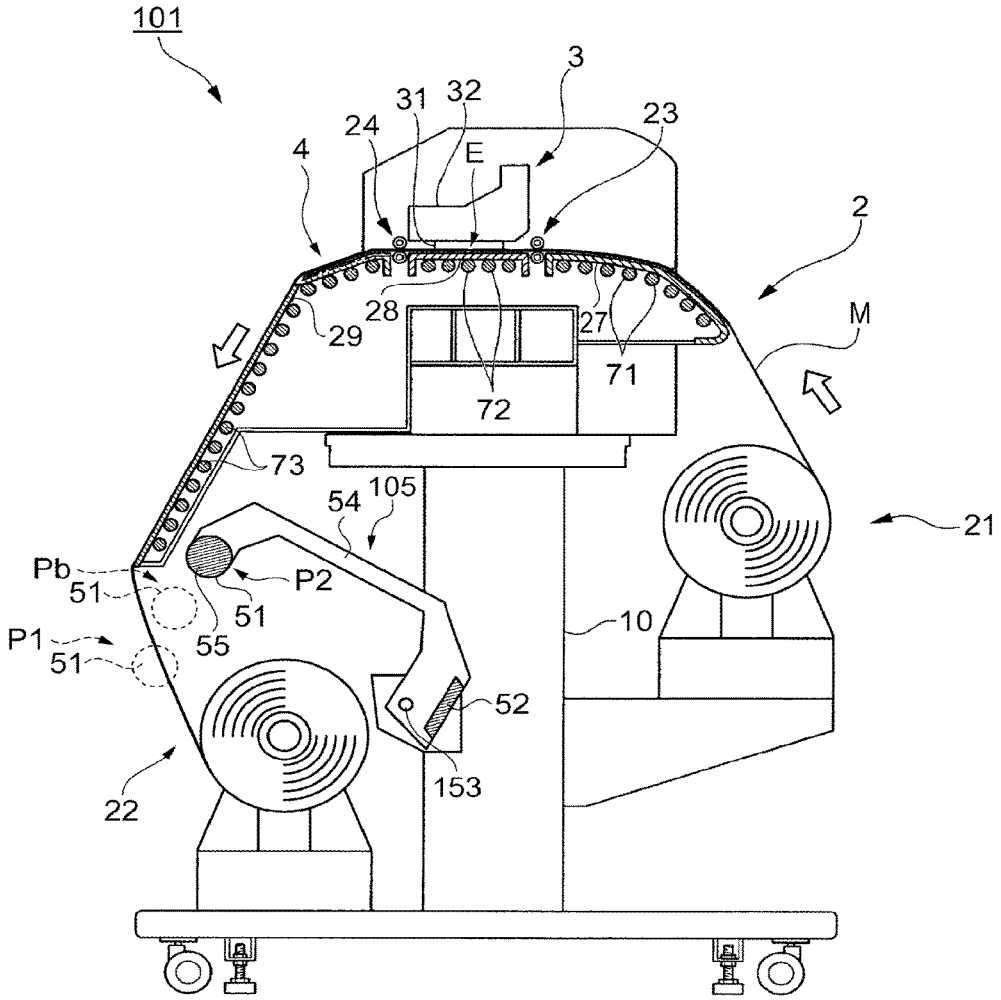
FIG. 7 schematically illustrates the configuration of the liquid ejecting apparatus.
Figure 8A:
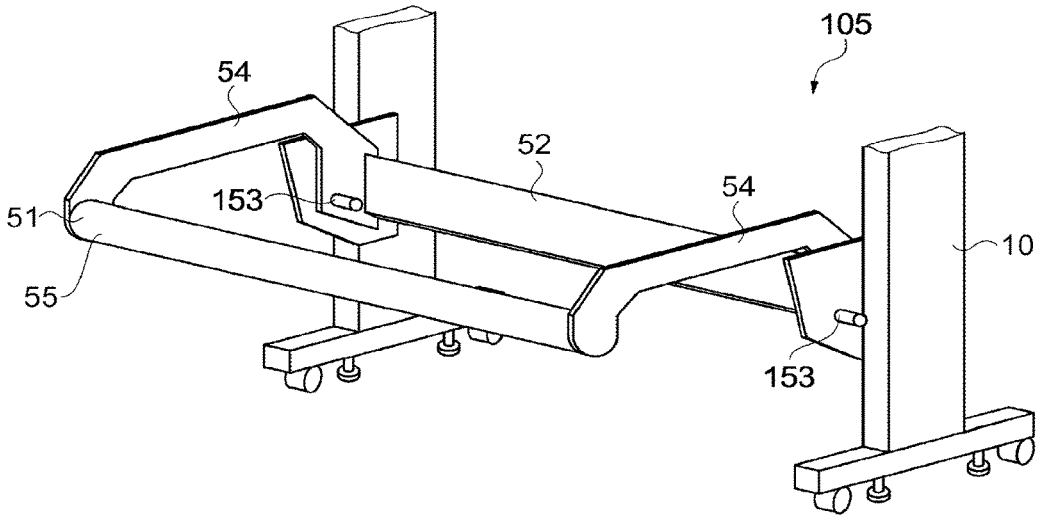
FIGS. 8A and 8B schematically illustrate a configuration of a tension adjusting unit.
Figure 8B:
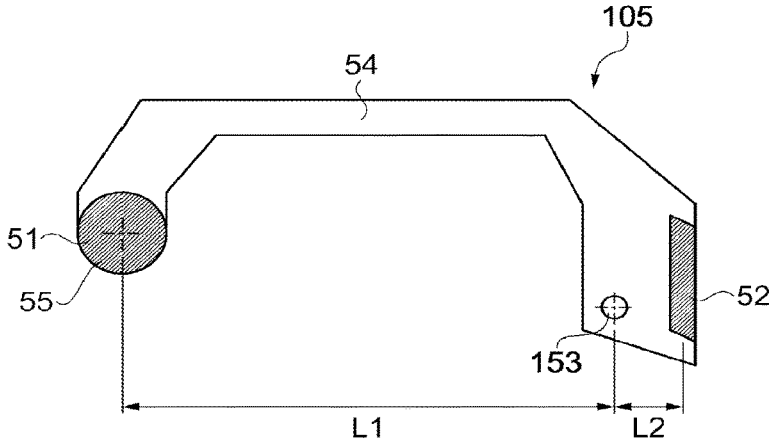

FIG. 5 illustrates the liquid ejecting apparatus 101 in a state in which the tension adjusting unit 105 is positioned at the first position P1. FIG. 6 illustrates the liquid ejecting apparatus 101 in a state in which the tension adjusting unit 105 is positioned at the balancing position Pb. FIG. 7 illustrates the liquid ejecting apparatus 101 in a state in which the tension adjusting unit 105 is positioned at the second position P2. FIG. 8A is an external perspective view illustrating the structure of the tension adjusting unit 105. FIG. 8B is a side cross-sectional view illustrating the structure of the tension adjusting unit 105.

As illustrated in FIGS. 5 to 7, the tension adjusting unit 105 includes the first weight member 51 and the second weight member 52. When the tension adjusting unit 105 is positioned closer to the first position P1 than the balancing position Pb which is between the first position P1 and the second position P2, the tension adjusting unit 105 is urged toward the first position P1 by the weight of the first weight member 51. When the tension adjusting unit 105 is positioned closer to the second position P2 than the balancing position Pb, the tension adjusting unit 105 is urged toward the second position P2 by the weight of the second weight member 52. Therefore, the posture of the tension adjusting unit 105 can be stabilized at each of the first position P1 at which the tension adjusting unit 105 applies the tension to the medium M and the second position P2 at which the tension adjusting unit 105 does not apply any tension to the medium M.

As illustrated in FIG. 8A, the tension adjusting unit 105 includes the pair of frames 54, and the first weight member 51 and the second weight member 52 are disposed between the pair of frames 54. In addition, the tension adjusting unit 105 includes the columnar tension bar 55, and the tension bar 55 is disposed between one-side ends of the frames 54. The tension bar 55 is formed to be longer than the width of the medium M in the width direction. Then, the part of the tension bar 55 comes into contact with the medium M and applies the tension to the medium M. Specifically, the tension bar 55 applies the tension to the medium M by coming into contact with the medium M. Note that, the tension bar 55 functions as the first weight member 51 in this embodiment. This can simplify the structure of the tension adjusting unit 105. The plate-shaped second weight member 52 is disposed between the other-side ends of the frames 54.

The tension adjusting unit 105 includes a shaft 153. The tension adjusting unit 105 can move between the first position P1 and the second position P2 by rotating about the shaft 153. As illustrated in FIG. 8B, the shaft 153 is located between the first weight member 51 (the tension bar 55) and the second weight member 52 in a side view of the tension adjusting unit 105.

As illustrated in FIG. 8B, a distance L1 between the first weight member 51 and the shaft 153 is different from a distance L2 between the second weight member 52 and the shaft 153. The position of the balancing position Pb can be adjusted by making there be a difference between the distance L1 that is a distance between the first weight member 51 and the shaft 153 and the distance L2 that is a distance between the second weight member 52 and the shaft 153. In addition, the weight of the first weight member 51 is different from the weight of the second weight member 52. The position of the balancing position Pb can be adjusted by making there be a difference between the weight of the first weight member 51 and the weight of the second weight member 52. In addition, the weight of one of the first weight member 51 and the second weight member 52 is greater than the weight of the other one. A distance between the shaft 153 and the one of the first weight member 51 and the second weight member 52 is shorter than a distance between the shaft 153 and the other one. In this manner, by adjusting the weights of the first and second weight members 51 and 52, and the distances between the shaft 153 and the first and second weight members 51 and 52, the posture of the tension adjusting unit 105 can be stabilized. In this embodiment, the weight of the second weight member 52 is greater than the weight of the first weight member 51. The distance L2 between the second weight member 52 the weight of which is greater than the weight of the first weight member 51 and the shaft 153 is shorter than the distance L1 between the first weight member 51 the weight of which is lower than the weight of the second weight member 52 and the shaft 153. When the tension adjusting unit 105 is positioned closer to the first position P1 than the balancing position Pb, the tension adjusting unit 105 is moved to the first position P1 by the weight of the first weight member 51 (see FIG. 5). Therefore, the tension adjusting unit 105 is prevented from stopping at an unstable position, and the posture of the tension adjusting unit 105 can be stabilized by the weight of the first weight member 51 at the first position P1. On the contrary, when the tension adjusting unit 105 is positioned closer to the second position P2 than the balancing position Pb, the tension adjusting unit 105 is moved to the second position P2 by the weight of the second weight member 52 (see FIG. 7). Therefore, the tension adjusting unit 105 is prevented from stopping at an unstable position, and the posture of the tension adjusting unit 105 can be stabilized by the weight of the second weight member 52 at the second position P2. Accordingly, the posture of the tension adjusting unit 105 can be stabilized at each of the first position P1 and the second position P2. Note that, as illustrated in FIG. 6, the balancing position Pb represents a position at which an urging force of the first weight member 51 is balanced with an urging force of the second weight member 52. Note that, in this embodiment, the urging force of the first weight member 51 represents an urging force counterclockwise in FIG. 6, and the urging force of the second weight member 52 represents an urging force clockwise in FIG. 6.

Next, a moving method for moving the tension adjusting unit 105 will be described. Note that this embodiment describes the moving method for moving the tension adjusting unit which is included in the liquid ejecting apparatus 101, the tension adjusting unit 105 including the first weight member 51 and the second weight member 52, and being movable between the first position P1 and the second position P2, the first position P1 being a position at which the tension adjusting unit 105 applies the tension to a medium M onto which ink as a liquid is ejected, and the second position P2 being a position at which the tension adjusting unit 105 does not apply any tension to the medium M.

At first, in the case of applying the tension to the medium M, that is, in the case of recording (printing) images, characters, and the like onto the medium M by driving the ejecting unit 3, and transporting the medium M, the tension adjusting unit 105 is moved to a position at which an urging force is applied in a direction from the second position P2 to the first position P1 by the weight of the first weight member 51 (the tension bar 55). Then, the first weight member 51 (the tension bar 55) moves to the first position P1 side of the balancing position Pb and moves to the first position P1 by the weight of the first weight member 51. Thus, as illustrated in FIG. 5, the posture of the tension adjusting unit 105 is stabilized at the first position P1.

On the contrary, when the tension adjusting unit 105 does not apply any tension to the medium M, that is, in a non-printing time, for example, when the roller 22 rolling up the medium M is removed, the tension adjusting unit 105 is moved to a position at which an urging force is applied in a direction from the first position P1 to the second position P2 by a weight of the second weight member 52. Then, the second weight member 52 moves to the second position P2 side of the balancing position Pb and moves to the second position P2 by the weight of the second weight member 52. Thus, as illustrated in FIG. 7, the posture of the tension adjusting unit 105 is stabilized at the second position P2.

The above-described embodiment ensures the following effects.

In a case where the tension adjusting unit 105 applies the tension to the medium M, the tension adjusting unit 105 can move to the first position P1. In a case where the tension adjusting unit 105 does not apply any tension to the medium M, the tension adjusting unit 105 can move to the second position P2. The tension adjusting unit 105 is urged by the weight of the first weight member 51 at the first position P1. The tension adjusting unit 105 is urged by the weight of the second weight member 52 at the second position P2. Therefore, the posture of the tension adjusting unit 105 can be stabilized readily at each of the first and second positions P1 and P2. By stabilizing the posture of the tension adjusting unit 105 particularly at the second position P2, the roller 22 around which the medium M has been rolled up can be removed readily. This can improve operability. In addition, the tension is applied to the medium M only by the weight of the first weight member 51 (the tension bar 55) at the first position P1. Therefore, the variation in the tension, which is applied to the medium M, can be suppressed, and thus the medium M can be transported more stably.

Note that the invention is not limited to the exemplary embodiments described above and may be modified and improved in various ways. Modification Examples will be described below.

First Modification Example

In the above-described embodiments, the tension bar 55 serves as the first weight member 51. However, the invention is not limited to this configuration. For example, the first weight member 51 and the tension bar 55 are disposed separately. For example, the first weight member 51 may be disposed separately at a periphery of the tension bar 55. This modification example can also ensure the same effects as the above-described effects.

Second Modification Example

In the above-described embodiments, the third heater 73 is adhered to the rear surface of the downstream supporting member 29. However, the invention is not limited to this configuration. For example, the heating unit (a heater, etc.) capable of heating the medium M may be disposed at a position facing the downstream supporting member 29. That is, the medium M may be heated from a surface thereof, the surface having received ink from the ejecting unit 3. This modification example can also ensure the same effects as the above-described effects.

Third Modification Example

The liquid ejecting apparatus may discharge or eject liquid other than ink. For example, this liquid ejecting apparatus can be used for a recording apparatus which includes a recording head and the like for ejecting a liquid droplet in a minute amount. Note that, the liquid droplet represents a state of liquid, which is ejected from the recording apparatus, and includes liquid in a granular shape, liquid in a tear shape, and liquid which tails in a string shape. The liquid may be material which can be ejected (discharged) from the liquid ejecting apparatus. For example, the liquid may be a material in a liquid phase and includes a material in a flow state such as a liquid of high or low viscosity, sol, gel, other inorganic solvent, organic solvent, solution, liquid resin, and liquid metal (metal melt). In addition, the liquid includes not only liquid as one state of material but also solvent in which particles of solid functional material such as pigment and metal particles are dissolved, dispersed, and mixed. A typical example of liquid includes ink in the above-described embodiments. The ink includes various liquid compositions such as normal water-based ink, oil-based ink, gel-based ink, and hot melt ink. The medium includes a functional paper which can be thinly elongated by using a thermal technique, a textile such as a woven article and a cloth, a substrate, and a metal plate besides a plastic film such as s vinyl chloride-based film.

The entire disclosure of Japanese Patent Application No.: 2014-202862, filed Oct. 1, 2014 and 2014-202865, filed Oct. 1, 2014 are expressly incorporated reference herein.

What is claimed is:

1. A liquid ejecting apparatus comprising:

an ejecting unit that is capable of ejecting a liquid;

a tension adjusting unit that is rotatable about a rotational shaft at an opposite end of the tension adjusting unit from a tension bar for coming into contact with the medium, wherein the tension adjusting unit is capable of applying a tension to a medium by coming into contact with the medium onto which the liquid is ejected; and a fixing unit that is capable of fixing the tension adjusting unit; and wherein the fixing unit fixes the tension adjusting unit at a retracted position at which the tension adjusting unit does not apply any tension to the medium.

2. The liquid ejecting apparatus according to claim 1, wherein the rotational shaft substantially coincides with a center of gravity of the tension adjusting unit.

3. The liquid ejecting apparatus according to claim 1, wherein the tension adjusting unit is capable of applying the tension to the medium by a weight of the tension bar.

4. The liquid ejecting apparatus according to claim 1, wherein the fixing unit includes a magnet, and the magnet fixes the tension adjusting unit.

5. The liquid ejecting apparatus according to claim 1, wherein the fixing unit includes an arm, and the arm fixes the tension adjusting unit.

6. The liquid ejecting apparatus according to claim 1, wherein the tension adjusting unit is set to be downstream of the ejecting unit.

7. The liquid ejecting apparatus according to claim 1, wherein the tension adjusting unit includes a weight member and a pair of frames, and the pair of frames is connected by the tension bar and the weight member.

8. The liquid ejecting apparatus according to claim 7, wherein each frame of the pair of frames is formed in an arch-shape in a view along a width direction of the medium.

* * * * *